US006425652B2

(12) United States Patent
Otsuki

(10) Patent No.: US 6,425,652 B2
(45) Date of Patent: Jul. 30, 2002

(54) BIDIRECTIONAL PRINTING THAT TAKES ACCOUNT OF MECHANICAL VIBRATIONS OF PRINT HEAD

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/785,199

(22) Filed: Feb. 20, 2001

(30) Foreign Application Priority Data

Feb. 21, 2000 (JP) ..... 2000-042700

(51) Int. Cl.[7] ..... B41J 2/15
(52) U.S. Cl. ..... 347/41; 347/14; 347/43
(58) Field of Search ..... 347/41, 12, 40, 347/9, 14, 15, 43, 19, 16; 358/1.2, 1.8

(56) References Cited

U.S. PATENT DOCUMENTS

| | | | | |
|---|---|---|---|---|
| 4,198,642 A | | 4/1980 | Gamblin | 347/41 |
| 4,272,771 A | * | 6/1981 | Furukawa | 347/41 |
| 4,509,058 A | * | 4/1985 | Fischbeck | 347/41 |
| 4,575,730 A | * | 3/1986 | Logan et al. | 347/75 |
| 5,075,689 A | * | 12/1991 | Hoisington et al. | 347/41 |
| 5,841,451 A | | 11/1998 | Hirabayashi et al. | 347/41 |
| 5,956,055 A | * | 9/1999 | Gibson et al. | 347/40 |

FOREIGN PATENT DOCUMENTS

| | | |
|---|---|---|
| DE | 41 07 036 | 9/1991 |
| EP | 0 367 059 | 5/1990 |
| EP | 0 667 242 | 8/1995 |
| EP | 0 679 518 | 11/1995 |
| JP | 7-251513 | 10/1995 |
| WO | WO 91/17892 | 11/1991 |

* cited by examiner

*Primary Examiner*—Lamson D. Nguyen
(74) *Attorney, Agent, or Firm*—Oblon, Spivak, McClelland, Maier & Neustadt, P.C.

(57) ABSTRACT

The recording technique of the present invention is applied to a printer that has a print head, which causes a partial area of main scan to have a lower positional accuracy of dot creation, and carries out bi-directional printing, which causes the print head to create dots on a printing medium in both forward and backward passes of the main scan. The recording technique records dots in such a manner that forward pass dots created in the forward pass of the main scan and backward pass dots created in the backward pass of the main scan are present at substantially equal rates in at least specific areas close to both ends of the main scan. This arrangement of the present invention desirably improves the printing quality in the case of bi-directional printing.

12 Claims, 13 Drawing Sheets

Fig.6

Parameters

Nozzle Pitch k : 6

Number of Working Nozzles N : 47

Number of Repeated Scans s : 2

Number of Effective Nozzles Neff : 47/2

| Pass Numbers | 1 | 2 | 3 | 4 | 5 | 6 | 7 | 8 | 9 | 10 | 11 | 12 | 13 |
|---|---|---|---|---|---|---|---|---|---|---|---|---|---|
| Feeding Amount | 0 | 21 | 26 | 21 | 26 | 21 | 26 | 21 | 26 | 21 | 26 | 21 | 26 |
| ΣL | 0 | 21 | 47 | 68 | 94 | 115 | 141 | 162 | 188 | 209 | 235 | 256 | 282 |
| F=(ΣL)%k | 0 | 3 | 5 | 2 | 4 | 1 | 3 | 0 | 2 | 5 | 1 | 4 | 0 |
| Horizontal Positions | 1 | 2 | 1 | 2 | 1 | 2 | 1 | 2 | 1 | 2 | 1 | 2 | 1 |

Raster numbers

| | | | | | | | | | | | | | |
|---|---|---|---|---|---|---|---|---|---|---|---|---|---|
| 1 | | | 35 | | | | | | | 8 | | | |
| 2 | 43 | | | | | | | 16 | | | | | |
| 3 | | | | | | 24 | | | | | 4 | | |
| 4 | | | | 32 | | | | | 12 | | | | |
| 5 | | 40 | | | | | 20 | | | | | | |
| 6 | | | | | 28 | | | | | | | 1 | |
| 7 | | | 36 | | | | | | | 9 | | | |
| 8 | 44 | | | | | | | 17 | | | | | |
| 9 | | | | | | 25 | | | | | 5 | | |
| 10 | | | | 33 | | | | | 13 | | | | |
| 11 | | 41 | | | | | 21 | | | | | | |
| 12 | | | | | 29 | | | | | | | 2 | |
| 13 | | | 37 | | | | | | | 10 | | | |
| 14 | 45 | | | | | | | 18 | | | | | |
| 15 | | | | | | 26 | | | | | 6 | | |
| 16 | | | | 34 | | | | | 14 | | | | |
| 17 | | 42 | | | | | 22 | | | | | | |
| 18 | | | | | 30 | | | | | | | 3 | |
| 19 | | | 38 | | | | | | | 11 | | | |
| 20 | 46 | | | | | | | 19 | | | | | |
| 21 | | | | | | 27 | | | | | 7 | | |
| 22 | | | | 35 | | | | | 15 | | | | |
| 23 | | 43 | | | | | 23 | | | | | | |
| 24 | | | | | 31 | | | | | | | 4 | |
| 25 | | | 39 | | | | | | | 12 | | | |
| 26 | 47 | | | | | | | 20 | | | | | |
| 27 | | | | | | 28 | | | | | 8 | | |
| 28 | | | | 36 | | | | | 16 | | | | |
| 29 | | 44 | | | | | 24 | | | | | | |
| 30 | | | | | 32 | | | | | | | 5 | |
| 31 | | | 40 | | | | | | | 13 | | | |
| 32 | | | | | | | | 21 | | | | | 1 |
| 33 | | | | | | 29 | | | | | 9 | | |
| 34 | | | | 37 | | | | | 17 | | | | |
| 35 | | 45 | | | | | 25 | | | | | | |
| 36 | | | | | 33 | | | | | | | 6 | |
| 37 | | | 41 | | | | | | | 14 | | | |
| 38 | | | | | | | | 22 | | | | | 2 |

Horizontal Positions

| 1 | 2 |
|---|---|
| 1 | 8 |
| 11 | 6 |
| 9 | 4 |
| 7 | 2 |
| 5 | 12 |
| 3 | 10 |

Fig.8

Parameters

| | | |
|---|---|---|
| Nozzle Pitch k | : | 6 |
| Numer of Working Nozzles | : | 48 |
| Number of Repeated Scans | : | 2 |
| Number of Effective Nozzles | : | 24 |

| Pass Number | 1 | 2 | 3 | 4 | 5 | 6 | 7 | 8 | 9 | 10 | 11 | 12 | 13 |
|---|---|---|---|---|---|---|---|---|---|---|---|---|---|
| Feeding Amounts | 0 | 20 | 27 | 22 | 28 | 21 | 26 | 20 | 27 | 22 | 28 | 21 | 26 |
| ΣL | 0 | 20 | 47 | 69 | 97 | 118 | 144 | 164 | 191 | 213 | 241 | 262 | 288 |
| F=(ΣL)%k | 0 | 2 | 5 | 3 | 1 | 4 | 0 | 2 | 5 | 3 | 1 | 4 | 0 |
| Horizontal Position | 1 | 2 | 1 | 2 | 1 | 2 | 2 | 1 | 2 | 1 | 2 | 1 | 1 |

Raster Numbers

| | | | | | | | | | | | | | |
|---|---|---|---|---|---|---|---|---|---|---|---|---|---|
| 1 | | | 36 | | | | | | 12 | | | | |
| 2 | 44 | | | | | | 20 | | | | | | |
| 3 | | | | | 28 | | | | | | 4 | | |
| 4 | | 41 | | | | | | 17 | | | | | |
| 5 | | | | 33 | | | | | | 9 | | | |
| 6 | | | | | | 25 | | | | | | 1 | |
| 7 | | | 37 | | | | | | 13 | | | | |
| 8 | 45 | | | | | | 21 | | | | | | |
| 9 | | | | | 29 | | | | | | 5 | | |
| 10 | | 42 | | | | | | 18 | | | | | |
| 11 | | | | 34 | | | | | | 10 | | | |
| 12 | | | | | | 26 | | | | | | 2 | |
| 13 | | | 38 | | | | | | 14 | | | | |
| 14 | 46 | | | | | | 22 | | | | | | |
| 15 | | | | | 30 | | | | | | 6 | | |
| 16 | | 43 | | | | | | 19 | | | | | |
| 17 | | | | 35 | | | | | | 11 | | | |
| 18 | | | | | | 27 | | | | | | 3 | |
| 19 | | | 39 | | | | | | 15 | | | | |
| 20 | 47 | | | | | | 23 | | | | | | |
| 21 | | | | | 31 | | | | | | 7 | | |
| 22 | | 44 | | | | | | 20 | | | | | |
| 23 | | | | 36 | | | | | | 12 | | | |
| 24 | | | | | | 28 | | | | | | 4 | |
| 25 | | | 40 | | | | | | 16 | | | | |
| 26 | 48 | | | | | | 24 | | | | | | |
| 27 | | | | | 32 | | | | | | 8 | | |
| 28 | | 45 | | | | | | 21 | | | | | |
| 29 | | | | 37 | | | | | | 13 | | | |
| 30 | | | | | | 29 | | | | | | 5 | |
| 31 | | | 41 | | | | | | 17 | | | | |
| 32 | | | | | | | 25 | | | | | | 1 |
| 33 | | | | | 33 | | | | | | 9 | | |
| 34 | | 46 | | | | | | 22 | | | | | |
| 35 | | | | 38 | | | | | | 14 | | | |
| 36 | | | | | | 30 | | | | | | 6 | |
| 37 | | | 42 | | | | | | 18 | | | | |
| 38 | | | | | | | 26 | | | | | | 2 |

Horizontal Position

| 1 | 2 |
|---|---|
| 1 | 7 |
| 5 | 11 |
| 8 | 2 |
| 10 | 4 |
| 12 | 6 |
| 3 | 9 |

Fig.10

Parameter

Nozzle Pitch k : 6

Number of Working Nozzles N : 46

Number of Repeated Scans s : 4

Number of Effective Nozzles Neff : 46/4

| Pass Numbers | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| Feeding Amounts | 0 | 9 | 8 | 15 | 14 | 9 | 8 | 15 | 14 | 9 | 8 | 15 | 14 | 9 | 8 | 15 | 14 | 9 | 8 | 15 | 14 | 9 | 8 | 15 | 14 |
| ΣL | 0 | 9 | 17 | 32 | 46 | 55 | 63 | 78 | 92 | 101 | 109 | 124 | 138 | 147 | 155 | 170 | 184 | 193 | 201 | 216 | 230 | 239 | 247 | 262 | 276 |
| F=(ΣL)%k | 0 | 3 | 5 | 2 | 4 | 1 | 3 | 0 | 2 | 5 | 1 | 4 | 0 | 3 | 5 | 2 | 4 | 1 | 3 | 0 | 2 | 5 | 1 | 4 | 0 |
| Horizontal Position | 1 | 2 | 3 | 4 | 1 | 2 | 3 | 2 | 1 | 4 | 3 | 2 | 3 | 4 | 1 | 2 | 3 | 4 | 1 | 4 | 3 | 2 | 1 | 4 | 1 |

Raster Numbers

| | | | | | | | | | | | | | | | | | | | | | | | | | |
|---|---|---|---|---|---|---|---|---|---|---|---|---|---|---|---|---|---|---|---|---|---|---|---|---|---|
| 1 | | | 41 | | | | | | | 27 | | | | | 18 | | | | | | | 4 | | | |
| 2 | 44 | | | | | | | 31 | | | | | 21 | | | | | | | 8 | | | | | |
| 3 | | | | | | 35 | | | | | 26 | | | | | | | 12 | | | | | 3 | | |
| 4 | | | | 39 | | | | | 29 | | | | | | | 16 | | | | | 6 | | | | |
| 5 | | 43 | | | | | 34 | | | | | | | 20 | | | | | 11 | | | | | | |
| 6 | | | | | 37 | | | | | | | 24 | | | | | 14 | | | | | | | | 1 |
| 7 | | | 42 | | | | | | | 28 | | | | | 19 | | | | | | | 5 | | | |
| 8 | 45 | | | | | | | 32 | | | | | 22 | | | | | | | 9 | | | | | |
| 9 | | | | | | 36 | | | | | 27 | | | | | | | 13 | | | | | 4 | | |
| 10 | | | | 40 | | | | | 30 | | | | | | | 17 | | | | | 7 | | | | |
| 11 | | 44 | | | | | 35 | | | | | | | 21 | | | | | 12 | | | | | | |
| 12 | | | | | 38 | | | | | | | 25 | | | | | 15 | | | | | | | | 2 |
| 13 | | | 43 | | | | | | | 29 | | | | | 20 | | | | | | | 6 | | | |
| 14 | 46 | | | | | | | 33 | | | | | 23 | | | | | | | 10 | | | | | |
| 15 | | | | | | 37 | | | | | 28 | | | | | | | 14 | | | | | 5 | | |
| 16 | | | | 41 | | | | | 31 | | | | | | | 18 | | | | | 8 | | | | |
| 17 | | 45 | | | | | 36 | | | | | | | 22 | | | | | 13 | | | | | | |
| 18 | | | | | 39 | | | | | | | 26 | | | | | 16 | | | | | | | | 3 |
| 19 | | | 44 | | | | | | | 30 | | | | | 21 | | | | | | | 7 | | | |
| 20 | | | | | | | | 34 | | | | | 24 | | | | | | | 11 | | | | | 1 |

Horizontal Position

| 1 | 2 | 3 | 4 |
|---|---|---|---|
| 1 | 8 | 13 | 20 |
| 23 | 6 | 11 | 18 |
| 9 | 16 | 21 | 4 |
| 19 | 2 | 7 | 14 |
| 5 | 12 | 17 | 24 |
| 15 | 22 | 3 | 10 |

Fig.11

Parameters

| | | |
|---|---|---|
| Nozzle Pitch k | : | 6 |
| Number of Working Nozzles N | : | 44 |
| Number of Repeated Scans s | : | 2 |
| Number of Effective Nozzles Neff | : | 22 |

| Pass Numbers | 1 | 2 | 3 | 4 | 5 | 6 | 7 | 8 | 9 | 10 | 11 | 12 | 13 |
|---|---|---|---|---|---|---|---|---|---|---|---|---|---|
| Feeding Amounts | 0 | 21 | 23 | 21 | 23 | 21 | 23 | 21 | 23 | 21 | 23 | 21 | 23 |
| ΣL | 0 | 21 | 44 | 65 | 88 | 109 | 132 | 153 | 176 | 197 | 220 | 241 | 264 |
| F=(ΣL)%k | 0 | 3 | 2 | 5 | 4 | 1 | 0 | 3 | 2 | 5 | 4 | 1 | 0 |
| Horizontal Positions | 1 | 2 | 1 | 2 | 1 | 2 | 2 | 1 | 2 | 1 | 2 | 1 | 1 |

Raster Numbers

| | | | | | | | | | | | | | |
|---|---|---|---|---|---|---|---|---|---|---|---|---|---|
| 1 | | | 33 | | | | | | 11 | | | | |
| 2 | | 37 | | | | | | 15 | | | | | |
| 3 | | | | | 26 | | | | | | 4 | | |
| 4 | | | | 30 | | | | | | 8 | | | |
| 5 | 41 | | | | | | 19 | | | | | | |
| 6 | | | | | | 23 | | | | | | 1 | |
| 7 | | | 34 | | | | | | 12 | | | | |
| 8 | | 38 | | | | | | 16 | | | | | |
| 9 | | | | | 27 | | | | | | 5 | | |
| 10 | | | | 31 | | | | | | 9 | | | |
| 11 | 42 | | | | | | 20 | | | | | | |
| 12 | | | | | | 24 | | | | | | 2 | |
| 13 | | | 35 | | | | | | 13 | | | | |
| 14 | | 39 | | | | | | 17 | | | | | |
| 15 | | | | | 28 | | | | | | 6 | | |
| 16 | | | | 32 | | | | | | 10 | | | |
| 17 | 43 | | | | | | 21 | | | | | | |
| 18 | | | | | | 25 | | | | | | 3 | |
| 19 | | | 36 | | | | | | 14 | | | | |
| 20 | | 40 | | | | | | 18 | | | | | |
| 21 | | | | | 29 | | | | | | 7 | | |
| 22 | | | | 33 | | | | | | 11 | | | |
| 23 | 44 | | | | | | 22 | | | | | | |
| 24 | | | | | | 26 | | | | | | 4 | |
| 25 | | | 37 | | | | | | 15 | | | | |
| 26 | | 41 | | | | | | 19 | | | | | |
| 27 | | | | | 30 | | | | | | 8 | | |
| 28 | | | | 34 | | | | | | 12 | | | |
| 29 | | | | | | | 23 | | | | | | 1 |
| 30 | | | | | | 27 | | | | | | 5 | |
| 31 | | | 38 | | | | | | 16 | | | | |
| 32 | | 42 | | | | | | 20 | | | | | |
| 33 | | | | | 31 | | | | | | 9 | | |
| 34 | | | | 35 | | | | | | 13 | | | |
| 35 | | | | | | | 24 | | | | | | 2 |
| 36 | | | | | | 28 | | | | | | 6 | |
| 37 | | | 39 | | | | | | 17 | | | | |
| 38 | | 43 | | | | | | 21 | | | | | |

Horizontal Positions

| 1 | 2 |
|---|---|
| 1 | 7 |
| 12 | 6 |
| 3 | 9 |
| 8 | 2 |
| 5 | 11 |
| 10 | 4 |

BIDIRECTIONAL PRINTING THAT TAKES ACCOUNT OF MECHANICAL VIBRATIONS OF PRINT HEAD

BACKGROUND OF THE INVENTION

1. Field of the Invention

The present invention relates to a printing technique that creates dots on a printing medium by forward and backward passes of main scan.

2. Description of the Related Art

The ink jet printer that causes a plurality of different color inks to be ejected from a print head is used as one of the output devices of the computer. For the enhanced printing speed, the multi-nozzle configuration and the bi-directional printing technique are generally applied for the ink jet printer. The multi-nozzle configuration uses a print head with a large number of nozzles arranged thereon, and the bi-directional printing technique carries out printing in both forward and backward passes of main scan.

The misalignment of positions where dots are created undesirably lowers the picture quality of the resulting image in the ink jet printer. It is thought that the positional misalignment is mainly ascribed to the ink ejection characteristics from the nozzles. The interlace technique or the overlap technique has been applied to reduce the effects of the positional misalignment and improve the picture quality of the resulting image.

The interlace technique forms raster lines in an intermittent manner in a sub-scanning direction to complete an image. For example, in the multi-nozzle configuration, it is assumed that the respective nozzles are disposed at intervals of not less than 2 raster lines in the sub-scanning direction. Because of this nozzle interval, every pass of the main scan forms raster lines in an intermittent manner in the sub-scanning direction. The vacant space between the existing raster lines is successively occupied by subsequent passes of the main scan with movements of the print head in sub-scan. The feeding amount of sub-scan is adequately selected to fill the vacancy and form adjoining raster lines with different nozzles. The interlace technique effectively disperses the positional misalignment in the sub-scanning direction, thereby making the positional misalignment sufficiently inconspicuous.

The overlap technique records dots on each raster line with at least two different nozzles. For example, the procedure creates dots in odd pixels on a certain raster line with one nozzle by a first pass of the main scan and dots in even pixels on the certain raster line with another nozzle by a second pass of the main scan. The overlap technique enables the positional misalignment to be well dispersed on the respective raster lines in a main scanning direction.

The interlace technique and the overlap technique are applicable for bi-directional printing. Dots created by the forward and the backward scans of the print head are arranged in various different patterns corresponding to the combinations of the nozzle pitch, the feeding amount of sub-scan, and the number of repeated scans.

In some cases, however, application of the interlace technique or the overlap technique does not sufficiently improve the picture quality. In the ink jet printers, a recent trend is the enhanced scanning speed of the print head to attain the higher-speed printing. Another trend is the use of finer dots for the better picture quality. Such attempts may, however, lead to the insufficient improvement in picture quality even under the application of the interlace technique or the overlap technique. This drawback is not negligible in the latest high-performance printers.

SUMMARY OF THE INVENTION

The object of the present invention is thus to improve the printing quality in the case of bi-directional printing.

At least part of the above and the other related objects is attained by the technique of the present invention, which is favorably applied to a printing apparatus where a partial area of main scan has a lower positional accuracy of dot creation. In such a printing apparatus, the technique records dots in such a manner that forward pass dots created in a forward pass of the main scan and backward pass dots created in a backward pass of the main scan are present at substantially equal rates in at least the partial area of the lower positional accuracy.

The inventors of the present invention have found that the positional misalignment of dot creation is ascribed to the mechanical configuration of the printing apparatus as well as to ink ejection characteristics. The inventors have also found that the positional misalignment appears at different positions in the forward pass and in the backward pass of the main scan. The technique of the present invention takes advantage of these findings and causes dots created in the forward pass to be mixed with dots created in the backward pass in an area of potential positional misalignment. This arrangement reduces the conspicuousness of the positional misalignment and thereby improves the picture quality of the resulting printed image.

Such a positional misalignment of dot creation may be ascribed to the mechanical vibrations of the print head in the course of the main scan. The increase in main scanning speed of the print head to enhance the printing speed and improve the performance of the printer leads to the greater mechanical vibrations of the print head. In general, the mechanical vibrations of the print head arise in the respective initial stages of the forward pass and the backward pass of the main scan (that is, at the time of accelerating the main scan) and gradually attenuate. In addition to the mechanical vibrations, application of the very fine dots created on the printing medium for the purpose of the improved printing quality causes even a slight positional misalignment of dot creation to make dropouts. In the case of bi-directional printing, the positional misalignment of dot creation is significantly conspicuous in some recording procedures.

FIG. 1 shows the effects of the mechanical vibrations on the picture quality. The dotted lines extending in the main scanning direction in images PICa and PICb represent raster lines. In the drawing of FIG. 1, the direction from left to right represents the direction of the forward pass of the main scan of the print head. The direction from right to left represents the direction of the backward pass of the main scan. As clearly understood from the illustration, the positions of dots are misaligned due to the mechanical vibrations of the print head arising in the respective initial stages of the forward pass and the backward pass of the main scan. The hatched areas represent specific areas of low positional accuracy, where the mechanical vibrations of the print head cause the positional misalignment of dot creation.

The upper portion of FIG. 1 shows an image PICa printed over the whole width in the main scanning direction. The image PICa has the specific areas of low positional accuracy on both ends thereof, due to the mechanical vibrations of the print head arising in both ends of the main scan range (that is, in the respective initial stages of the forward pass and the backward pass of the main scan).

There is a case in which an image occupies only part of the width in the main scanning direction. In such cases, the main scan is carried out only in the part of the width with the image, for the enhanced printing speed. The lower portion of FIG. 1 shows an image PICb printed by carrying out the main scan only in the part of the width in the main scanning direction. The image PICb also has the specific areas of low positional accuracy on both ends thereof.

In such areas of low positional accuracy, the positional misalignment of dot creation may be recognized visually as deterioration of the printing quality. FIG. 9 shows an arrangement, in which the bundle of 3 raster lines formed in the forward pass of the main scan and the bundle of 3 raster lines formed in the backward pass of the main scan appear alternately. In this drawing, the open circles represent the forward pass dots and the closed circles represent the backward pass dots. The dotted lines represent raster lines where dots are to be created. In this example, the effects of the positional misalignment of dot creation are observed on boundaries g1 through g3.

In one embodiment of the present invention, the recording procedure makes dots created in the initial stage of the forward pass of the main scan mixed with dots created in the terminal stage of the backward pass of the main scan in one end area of the main scan, while making dots created in the initial stage of the backward pass of the main scan mixed with dots created in the terminal stage of the forward pass of the main scan in the opposite end area of the main scan. In the respective initial stages of the forward pass and the backward pass of the main scan, the print head has large mechanical vibrations and creates dots with the poor positional accuracy. In the respective terminal stages, on the other hand, the vibrations sufficiently attenuate and resulting dots have the sufficiently high positional accuracy. This arrangement enables the dots of the poor positional accuracy and the dots of the sufficiently high positional accuracy to be present at substantially same rates in the areas of the lower positional accuracy. This effectively reduces the conspicuousness of the positional misalignment of dot creation and improves the printing quality in the case of bi-directional printing.

The technique of the present invention, which makes the dots of the relatively poor positional accuracy mixed with the dots of the relatively high positional accuracy, is applicable to the structure where the mechanical vibrations of the print head continue over the whole range of the main scan. The technique is also applicable to the structure where the mechanical vibrations of the print head do not significantly affect the printing quality.

In the technique of the present invention, the forward pass dots and the backward pass dots may be arranged to be adjacent to each other on an identical raster line or may be arranged alternately in the sub-scanning direction.

The technique of the present invention is favorably applied for a print head having a nozzle pitch of not less than 3 dot pitch in the sub-scanning direction.

The latest ink jet printers have extremely high resolutions and use very fine dots. The greater nozzle pitch of the print head is desirable from the viewpoints of the restrictions on manufacture of the print head and no overlap of blotting dots. In the case of the print head having the nozzle pitch equal to 2 dot pitch, there are only three procedures applicable to record dots: i) the first procedure creates dots in odd pixel (pixels having odd ordinal numbers allocated thereto) on each raster line in the forward pass of the main scan and dots in even pixels (pixels having even ordinal numbers allocated thereto) on the raster line in the backward pass of the main scan; ii) the second procedure forms odd raster lines (raster lines having odd ordinal numbers allocated thereto) in the forward pass of the main scan and even raster lines (raster lines having even ordinal numbers allocated thereto) in the backward pass of the main scan; and iii) the third procedure creates dots in pixels arranged in a checker pattern in one identical pass of the main scan. In the case of the print head having the nozzle pitch of not less than 3 dot pitch, however, there is a diversity of recording procedures having, for example, different feeding amounts of sub-scan and different numbers of repeated scans. The technique of the present invention specifies the optimum recording procedure to attain the improvement in picture quality, among the diversity of recording procedures.

In another embodiment of the present invention, the recording procedure makes the forward pass dots mixed with the backward pass dots in response to the setting of a predetermined print mode. This procedure of the embodiment changes the print data to be generated according to the selected print mode. In one possible modification, the print data to be generated may be changed according to the type of the printing medium. In another possible modification, the print data may be changed, based on the printing quality of the actual printing result. The predetermined print mode may be set arbitrarily and is, for example, a print mode used for printing natural images. In general, the natural image includes a large number of image parts in a medium tone range, where the positional misalignment of dots is rather conspicuous compared with image parts in a low tone range or those in a high tone range. Here the medium tone range represents tones in the middle of a reproducible tone range of the printing apparatus. Application of the recording method of the present invention for the natural images including lots of medium tones effectively improves the printing quality in the case of bi-directional printing.

The technique of the present invention is preferably applied for a print head that creates dots on a printing medium in such a manner that the dot percent is not greater than a predetermined level corresponding to the printing resolution. In general, the diameter of dots used for printing is set according to the resolution of the printed image. The dot diameter is affected not only by the printing resolution but by the type of the printing medium, the type of inks, and the printing environment. For example, the diameter of dots formed on special paper is smaller than the diameter of dots formed on ordinary paper. Even a slight positional misalignment of dot creation is likely to cause dropouts between such small-diametral dots adjoining to each other. This leads to deterioration of the printing quality. The small diametral dots are also affected significantly by the mechanical vibrations of the print head arising in the course of the main scan. The technique of the present invention is thus especially effective in the structure using the dots of a relatively small diameter.

The technique of the present invention is preferably applied for a print head that creates dots with pigment inks. In the case of printing with ordinary dye inks, ink droplets hit against the printing medium form adequately blotting dots. In the case of printing with pigment inks, however, the resulting dots hardly blot. Compared with printing with the ordinary dye inks, printing with the pigment inks is more likely to make dropouts, which have no dots formed therein, due to the positional misalignment of dot creation. This leads to deterioration of the printing quality. Application of the technique of the present invention to the printing apparatus using the pigment inks desirably improves the printing quality in the case of bi-directional printing.

The technique of the present invention is attained by a diversity of applications, which include a printing apparatus and a print control apparatus that generates print data for controlling an operation of a printer unit, as well as a printing method and a printing control method corresponding thereto. The technique may also be attained by a computer program to actualize any of such apparatuses and methods, a recording medium in which such a computer program is recorded, and a data signal that includes such a computer program and is embodied in a carrier wave.

In the case where the technique of the present invention is constructed in the form of a computer program or a recording medium in which the computer program is recorded, it may include all the functions of the print control apparatus or the printing apparatus or alternatively only part of the functions that are characteristic of the present invention. Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

BRIEF DESCRIPTION OF THE DRAWINGS

FIG. 6 shows a recording method in a first embodiment of the present invention;

FIG. 8 shows a dot recording method in a comparative example;

FIG. 10 shows one modification of the recording method of the first embodiment;

FIG. 11 shows a recording method in a second embodiment of the present invention;

DESCRIPTION OF THE PREFERRED EMBODIMENTS

Some modes of carrying out the present invention are discussed below as preferred embodiments in a following sequence:

A. Structure of Printing System
B. Print Control
C. First Embodiment
D. Modification of First Embodiment
E. Second Embodiment
F. Modifications

A. Structure of Printing System

Figure 1:
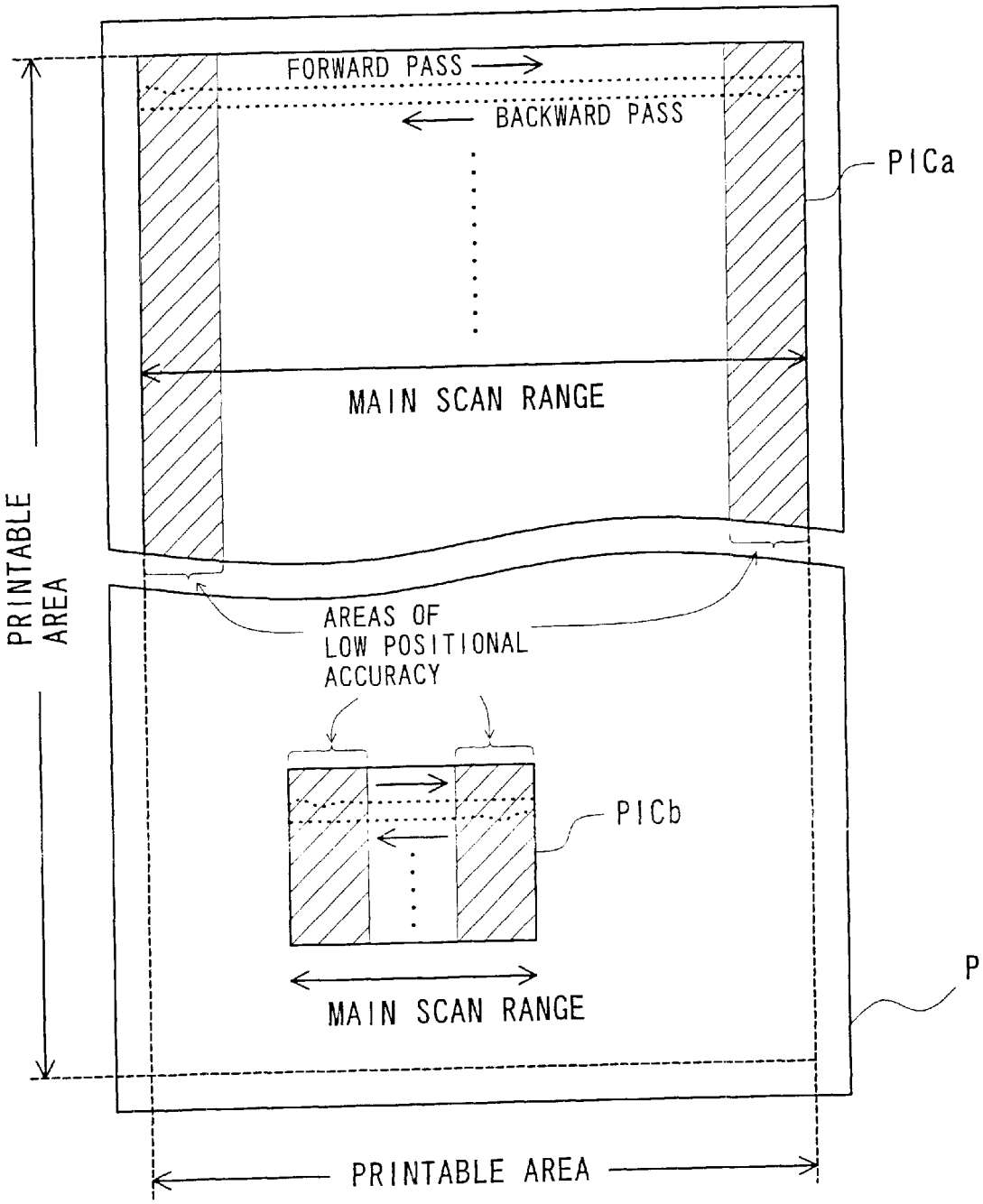
FIG. 1 shows a process of creating dots on raster lines with a print head where mechanical vibrations arise in the respective initial stages of a forward pass and a backward pass and gradually attenuate.
Figure 2:
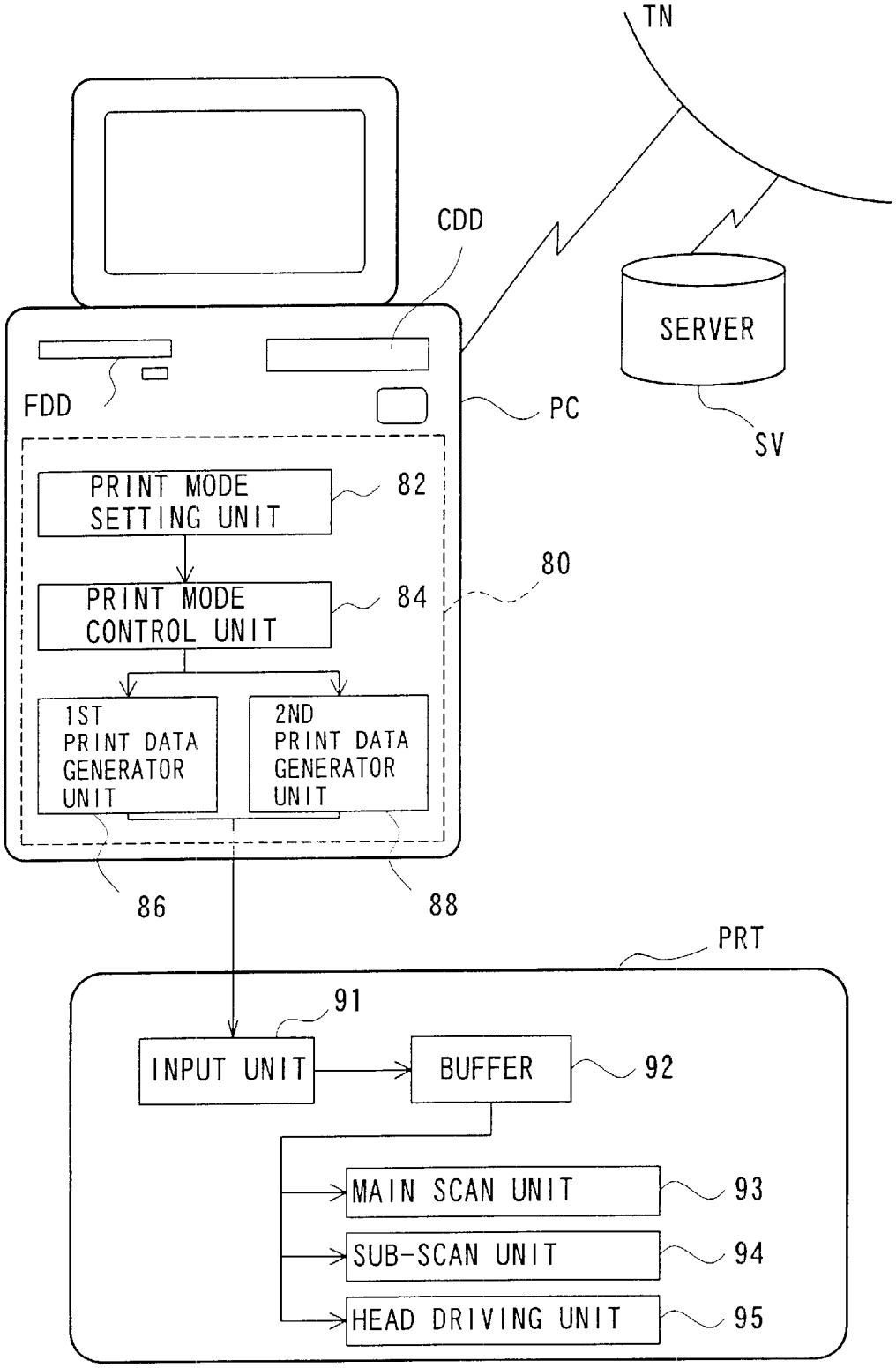
FIG. 2 is a block diagram illustrating the structure of a printing system embodying the present invention.

Referring to FIG. 2, a printing system embodying the present invention includes a printer PRT and a computer PC. A printer driver 80 that works under the control of a predetermined operating system is incorporated in the computer PC. The printer driver 80 receives image data from a variety of application programs running in the computer PC and generates print data. The print data controls a printing operation of the printer PRT and includes sub-scan feed amount data and raster line data that specifies the dot on-off state of each pixel in each pass of main scan in the printer PRT.

The computer PC is connected to an external network TN and communicates with a specific server SV to download the printer driver 80 and required data. The printer driver 80 and the required data may alternatively be loaded from a recording medium, such as a flexible disk or a CD-ROM, set in a flexible disk drive FDD or a CD-ROM drive CDD. In either case, the whole program of the printer driver 80 may be loaded collectively or only part of the functions may be loaded as modules.

The printer driver 80 includes a print mode setting unit 82, a print mode control unit 84, and two print data generator units 86 and 88.

The print mode setting unit 82 sets the print mode to either a pigment ink print mode that uses pigment inks for printing or a dye ink print mode that uses dye inks for printing. The print mode control unit 84 controls the proper use of the two print data generator units 86 and 88 according to the preset print mode. The first print data generator unit 86 is used in the case of the pigment ink print mode, whereas the second print data generator unit 88 is used in the case of the dye ink print mode.

Each of the two print data generator units 86 and 88 functions to generate print data from image data and includes a color conversion module, a halftone module, and an interlace module. The color conversion module refers to a lookup table and converts the color system of the image data expressed by RGB (red, green, and yellow) to tone data of respective inks used in the printer PRT, for example, cyan (C), magenta (M), and yellow (Y). The halftone module carries out halftoning to express the tone data as a distribution of dots. The interlace module sets the sub-scan feed amount data and rearranges the processed data, which has undergone the halftoning process, according to a format of data transfer to the printer PRT. The parameters used in these modules are regulated differently for the pigment inks and for the dye inks in the print data generator units 86 and 88. Part of the series of processing executed by the printer driver 80 may be carried out in the printer PRT.

The printer PRT receives the print data generated by the computer PC and carries out printing. The printer PRT includes an input unit 91, a buffer 92, a main scan unit 93, a sub-scan unit 94, and a head driving unit 95. The input unit 91 receives the print data from the computer PC. The print data is temporarily stored in the buffer 92. The main scan unit 93 and the sub-scan unit 94 respectively carry out the main scan of the print head and the feed of printing paper according to the print data stored in the buffer 92. The head driving unit 95 eventually dries the print head to print an image.

Figure 3:
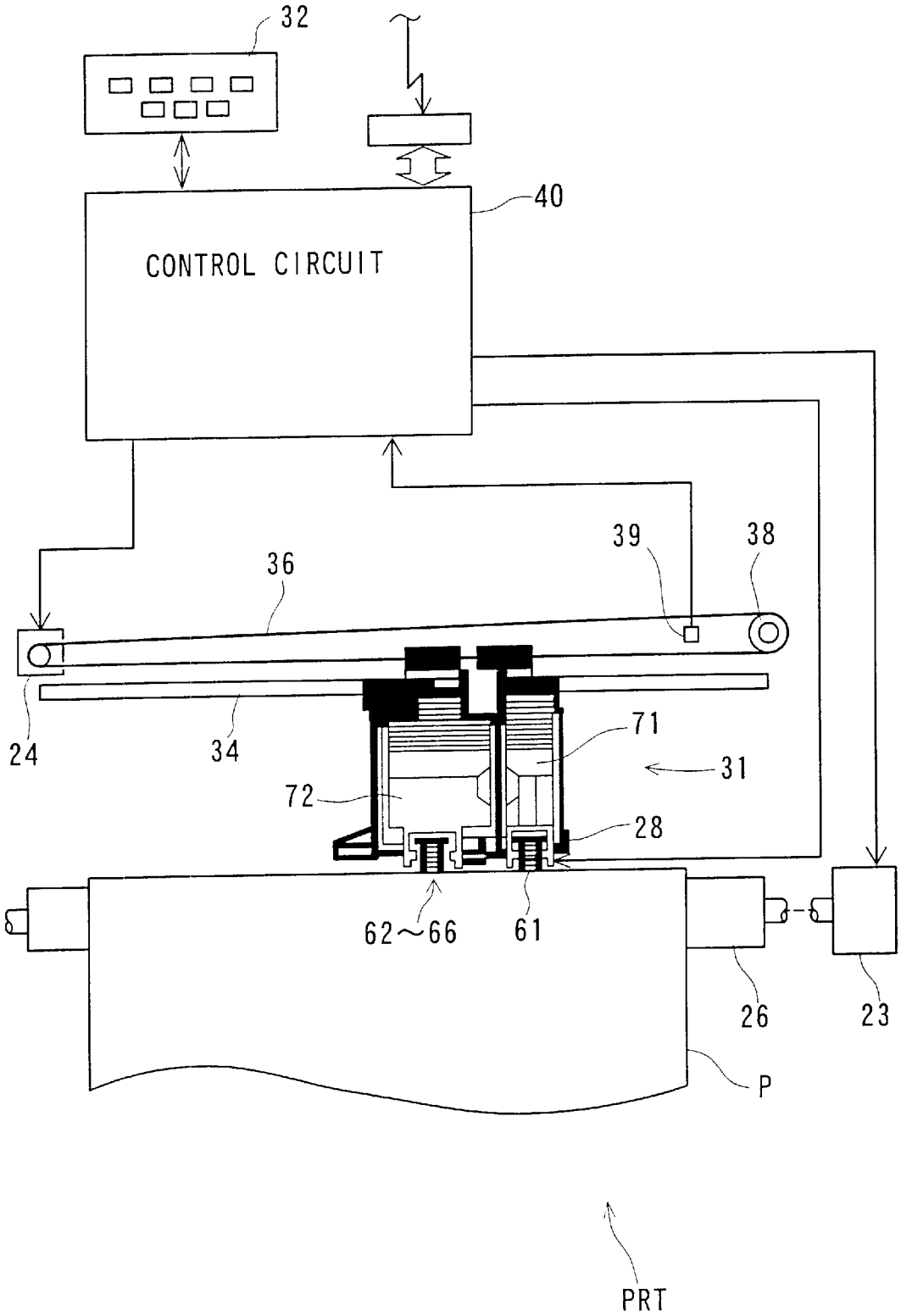
FIG. 3 schematically illustrates the structure of a printer included in the printing system.

FIG. 3 schematically illustrates the structure of the printer PRT. The printer PRT includes a main scan mechanism, a sub-scan mechanism, a head driving mechanism, and a control circuit 40 that controls these mechanisms and transmits signals to and from a control panel 32.

The sub-scan mechanism actuates a sheet feed motor 23 to feed a sheet of printing paper P. The amount of feeding the printing paper P represents the feed amount of sub-scan.

The main scan mechanism actuates a carriage motor 24 to move a carriage 31 back and forth along an axis of a platen 26. The head driving mechanism drives a print head 28 mounted on the carriage 31 in the course of the main scan and thereby creates dots.

The main scan mechanism includes a sliding shaft 34, a pulley 38, and a position detection sensor 39. The sliding shaft 34 is arranged in parallel with the axis of the platen 26 and supports the carriage 31 in a slidable manner. The pulley 38 is linked with the carriage motor 24 to hold an endless drive belt 36 spanned therebetween. The position detection sensor 39 detects the position of the origin of the carriage 31. In the course of the main scan, with a variation in velocity of the carriage 31, mechanical vibrations arise in the respective initial stages of the forward pass and the backward pass.

A black ink cartridge 71 that keeps black ink therein and a color ink cartridge 72 that keeps five different color inks, cyan, light cyan, magenta, light magenta, and yellow, therein are detachably attached to the carriage 31. The light cyan ink has a substantially identical hue with but a lower density than those of the cyan ink. The similar definition is applied for the light magenta ink. A total of six ink ejection heads 61 through 66 are formed corresponding to these six different inks in the print head 28 disposed on the lower portion of the carriage 31.

Figure 4:
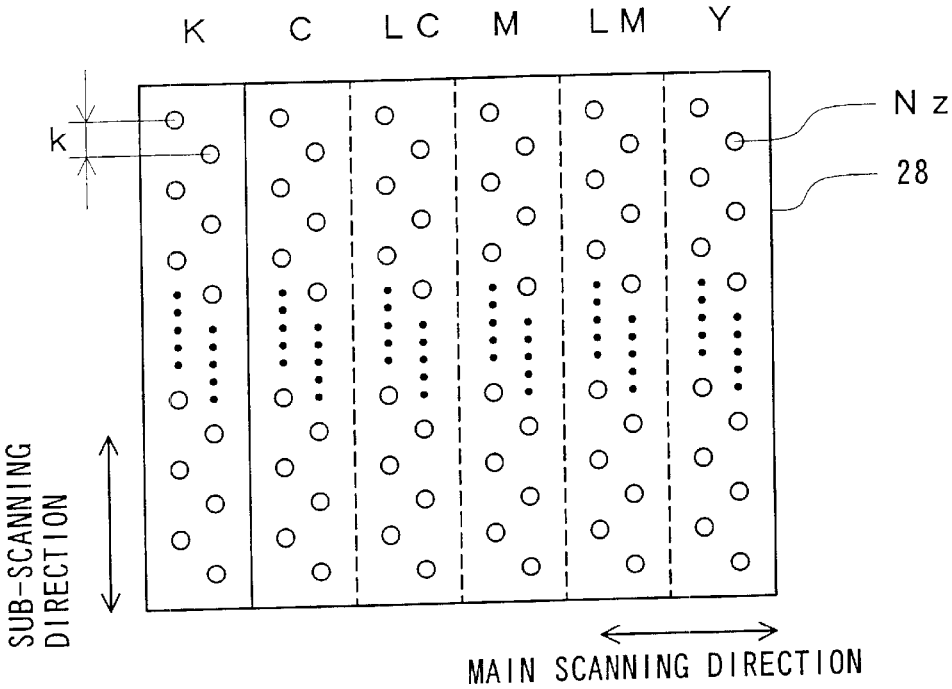
FIG. 4 shows an arrangement of nozzles in ink ejection heads.

FIG. 4 shows an arrangement of nozzles Nz in the respective ink ejection heads 61 through 66. Each of the ink ejection heads 61 through 66 has 48 nozzles Nz from which the corresponding color ink is ejected. The nozzles Nz are arranged in zigzag in a sub-scanning direction at a fixed nozzle pitch k. A piezoelectric element provided for each nozzle Nz is driven to cause the nozzle Nz to eject ink droplets of the corresponding color ink. In the structure of the embodiment, the nozzles Nz are arranged in zigzag to attain a small nozzle pitch in manufacture. The nozzles Nz may, however, alternatively be arranged in alignment. The positions of the corresponding nozzles in the respective ink ejection heads 61 through 66 are coincident with one another in the sub-scanning direction.

B. Print Control

Figure 5:
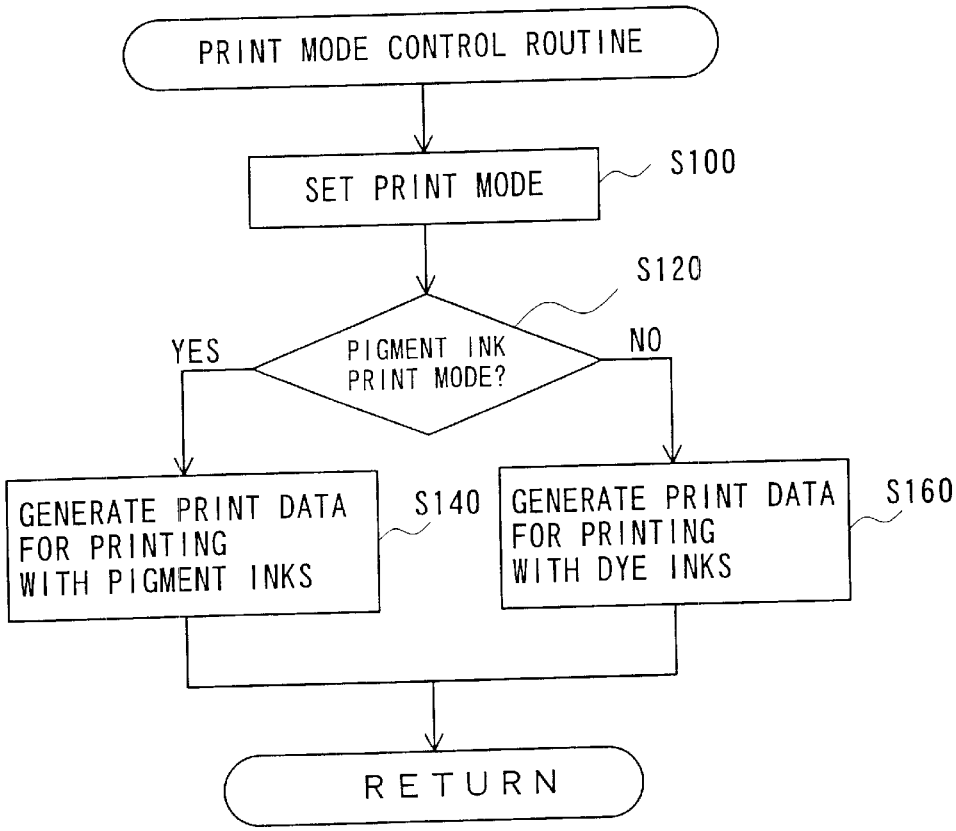
FIG. 5 is a flowchart showing a print mode control routine.

FIG. 5 is a flowchart showing a print mode control routine, which is executed by a CPU in the computer PC. When the program enters the routine, the CPU first sets the print mode to either one of the pigment ink print mode and the dye ink print mode, based on the type of inks used at step S100. When the print mode is set to the pigment ink print mode at step S120, print data is generated for printing with the pigment inks at step S140. When the print mode is set to the dye ink print mode at step S120, on the other hand, print data is generated for printing with the dye inks at step S160.

The print data includes the raster line data that specifies the dot on-off state on each pixel and the sub-scan feed amount data that specifies the feed amount of sub-scan. The printer PRT receives the print data and actually implements printing according to the input print data. In the structure of the embodiment, the printer PRT adopts the standard recording method, which is identical with the method of the prior art technique, in the dye ink print mode. The printer PRT, on the other hand, adopts a specified recording method that enables further improvement in picture quality, compared with the prior art technique, in the pigment ink print mode. The recording method adopted in the pigment ink print mode is described in detail below.

The printing method characteristic of the present invention is applied for the pigment ink print mode, because of the following reason. The pigment inks generally have the less blotting tendency than the dye inks. Compared with printing with the ordinary dye inks, printing with the pigment inks is more likely to make dropouts, which have no dots formed therein, due to the positional misalignment of dot creation. This leads to deterioration of the printing quality. Application of the technique of the present invention for the printing apparatus using the pigment inks desirably improves the printing quality in the case of bi-directional printing.

C. First Embodiment

FIGS. 6A and 6B show a recording method of a first embodiment. The recording method of the first embodiment causes dots created in the forward pass of the main scan (hereinafter referred to as the forward pass dots) and dots created in the backward pass of the main scan (hereinafter referred to as the backward pass dots) to be located adjacent to each other on an identical raster line. In the example of FIG. 6, the nozzle pitch k=6, the number of working nozzles N=47, and the number of repeated scans=2. The table of FIG. 6A shows parameters with regard to the respective passes of the main scan, $1^{st}$ scan to $13^{th}$ scan. One cycle includes 12 passes of the main scan and 12 (=k·s) passes of the sub-scan. The feeding amount of either 21 raster lines or 26 raster lines is applied for the 12 passes of the sub-scan. In the item of the horizontal position in the table of FIG. 6A, the value '1' represents recording in odd pixels (pixels having odd ordinal numbers allocated thereto) and the value '2' represents recording in even pixels (pixels having even ordinal numbers allocated thereto). Each odd pass (each pass having an odd ordinal number allocated thereto) of the main scan creates the forward pass dots, whereas each even pass (each pass having an even ordinal number allocated thereto) of the main scan creates the backward pass dots.

FIG. 6 also shows the recording result of dots, where the numerals represent nozzle numbers used for recording of dots on the respective raster lines by the 13 passes of the main scan. The raster line numbers on the left column are sequential numbers within an effective recording range. As illustrated in FIG. 6, each raster line is formed with two nozzles, where both the forward pass dots and the backward pass dots are present.

The right side of FIG. 6 shows the mapping of the passes in which the respective raster lines having the raster line numbers 2 through 7 to the horizontal position. In the first embodiment, k=6 and s=2. The dots over the whole image are created by the unit of total 12 pixels, that is, two pixels in the main scanning direction and the six pixels in the sub-scanning direction. The numerals in the columns represent the pass numbers. In the illustrated example, the odd pixels are recorded by the $1^{st}$, $11^{th}$, $9^{th}$, $7^{th}$, $5^{th}$, and $3^{rd}$ passes, whereas the even pixels are recorded by the $8^{th}$, $6^{th}$, $4^{th}$, $2^{nd}$, $12^{th}$, and $10^{th}$ passes. Namely the forward pass dots are recorded in the odd pixels, and the backward pass dots are recorded in the even pixels. The arrangement of separating the positions of dots in the main scanning direction and in the sub-scanning direction created by any consecutive passes of the main scan effectively prevents blotting due to overlap of dots.

Figure 7:
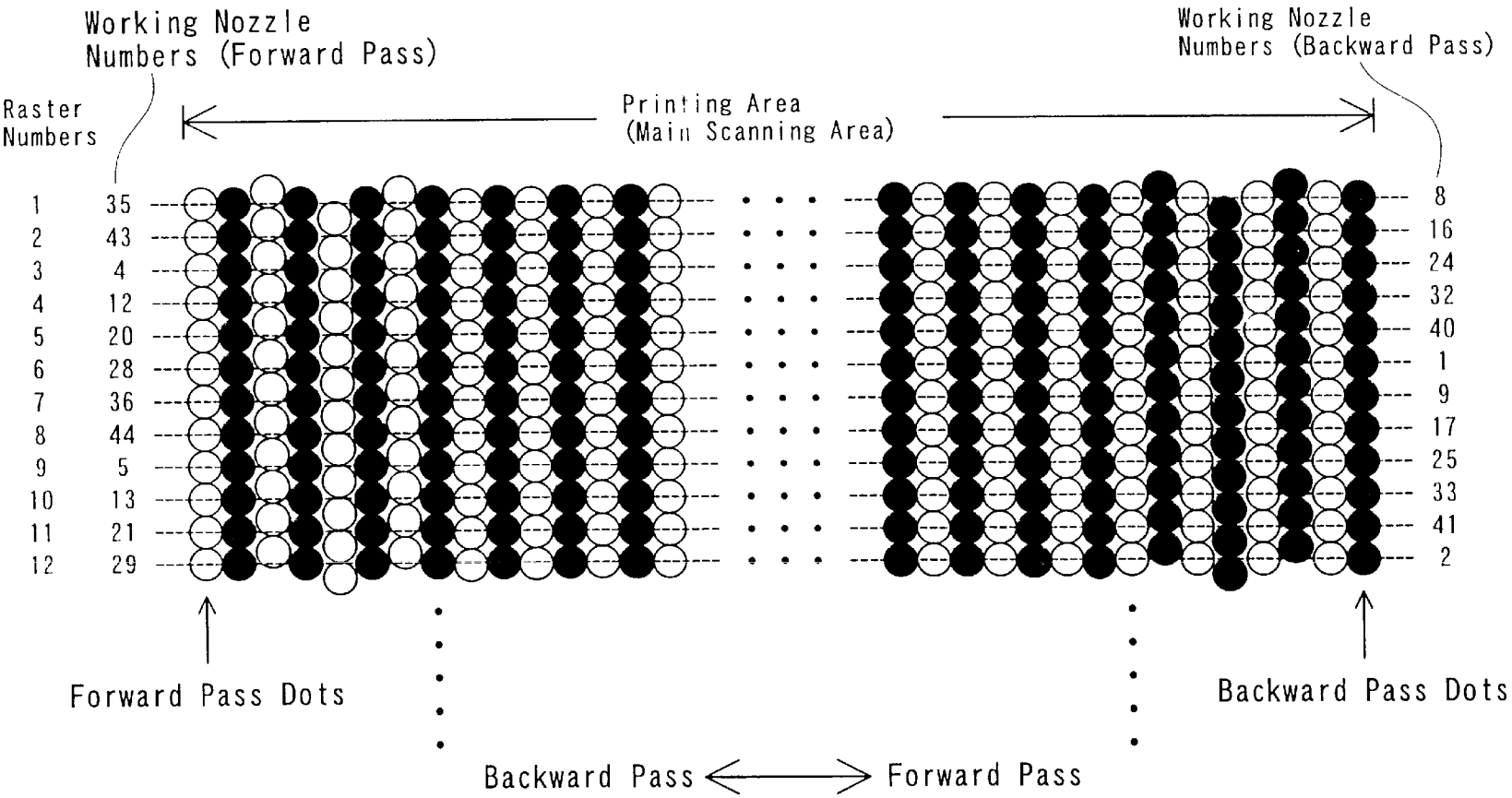
FIG. 7 shows dots created by the recording method of the first embodiment.

FIG. 7 shows resulting dots created by the recording method of the first embodiment. This result shows the effects of mechanical vibrations that occur on the print head in the initial stage of the main scan and gradually attenuate. The movement from left to right on the drawing is the forward pass, and the reverse movement is the backward pass. The open circles represent the forward pass dots, and the closed circles represent the backward pass dots. The broken line represents the expected positions of dots to be created in each raster line. The mechanical vibrations of the print head shift the positions of the forward pass dots in the sub-scanning direction in an area close to the left end, while shifting the positions of the backward pass dots in the sub-scanning direction in an area close to the right end. This arrangement disperses the dots of poor positional accuracy in the main scanning direction and thereby reduces the adverse effects of the positional misalignment of dots on the picture quality.

Figure 9:
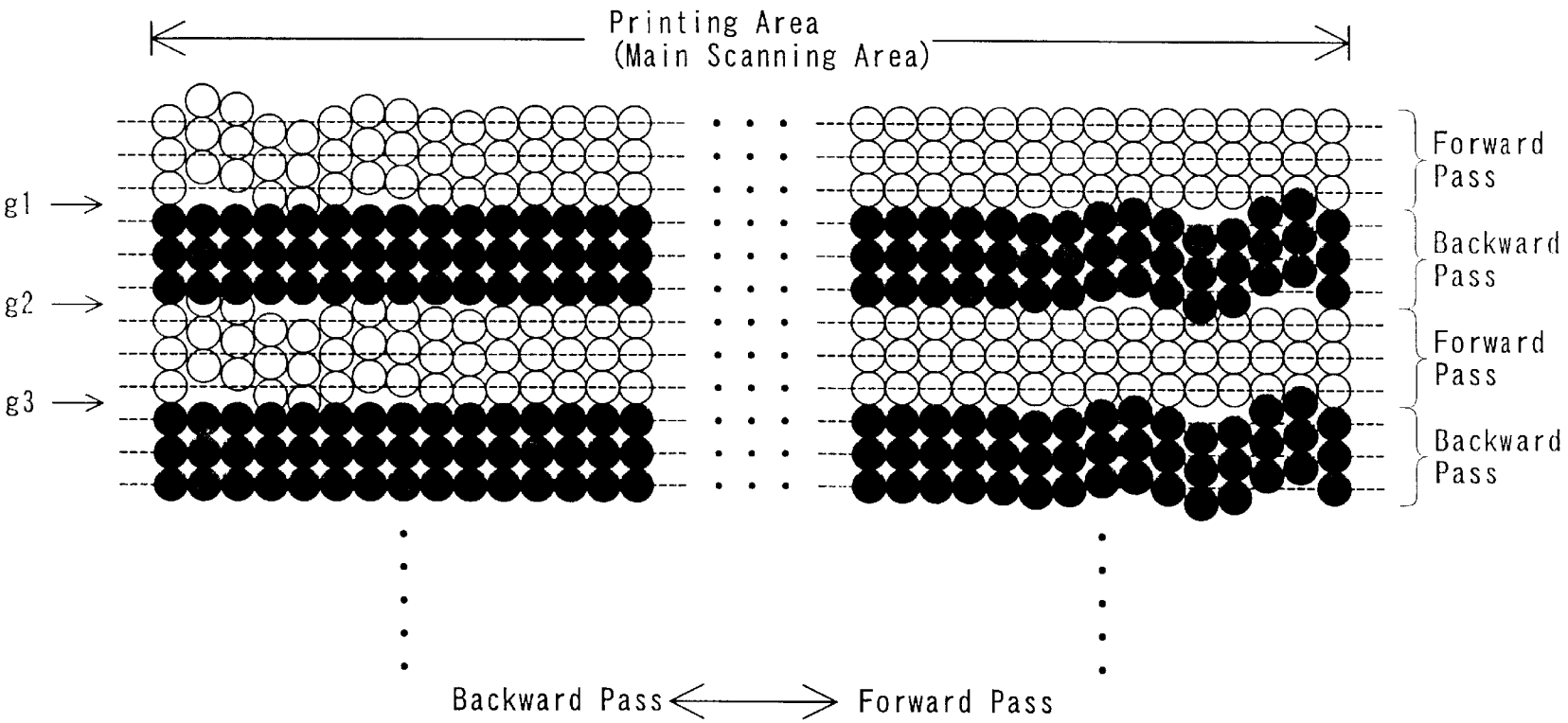
FIG. 9 shows dots created by the recording method of the comparative example.

FIGS. 8 and 9 show a recording method in a comparative example, which makes the effects of the positional misalignment significantly prominent. As shown in FIG. 8, the recording method of the comparative example forms the raster lines such that the bundle of 3 raster lines recorded with the forward pass dots and the bundle of 3 raster lines recorded with the backward pass dots appear alternately.

FIG. 9 shows resulting dots created by the recording method of the comparative example. In this example, the positions of dots are misaligned at every 3 raster lines in both the end areas. Namely the significant positional misalignment is observed on the boundaries g1 through g3 between the dots of good positional accuracy and the dots of poor positional accuracy.

As described above, the recording method of the first embodiment alternately creates the forward pass dots and the backward pass dots on each raster line, thereby dispersing the dots of poor positional accuracy. Even when mechanical vibrations arise on the print head, this arrangement reduces the conspicuousness of the positional misalignment and thereby improves the picture quality of the resulting printed image.

D. Modification of First Embodiment

A variety of other methods are applicable to record the forward pass dots and the backward pass dots to be mutually adjacent to each other on each raster line. FIG. 10 show a recording method in one modification of the first embodiment, where the number of repeated scans s=4 (namely, each raster line is completed by 4 passes of the main scan). In this modified example, one cycle includes 24 (=k·s) passes of the main scan and 24 passes of the sub-scan. The horizontal position represents the recording position among four consecutive pixels on each raster line.

As shown in FIG. 10, both the forward pass dots and the backward pass dots created with four different nozzles are present on each raster line.

The recording method of this modified example also enables the forward pass dots and the backward pass dots to be created alternately on each raster line, and thereby reduces the adverse effects of the positional misalignment of dots due to the mechanical vibrations on the picture quality of the resulting printed image.

E. Second Embodiment

FIG. 11 show another recording method in a second embodiment of the present invention. The recording method of the second embodiment arranges the forward pass dots and the backward pass dots alternately in the sub-scanning direction. In the example of FIG. 11, the number of repeated scans s=2, and one cycle includes 12 (=k·s) passes of the main scan and 12 passes of the sub-scan.

As shown in FIG. 11, each raster line is formed with two different nozzles, but includes only either the forward pass dots or the backward pass dots. The raster line recorded with the forward pass dots (hereinafter referred to as the forward pass raster line) and the raster line recorded with the backward pass dots (hereinafter referred to as the backward pass raster line) adjoin to each other, and neither any two forward pass raster lines nor any two backward pass raster lines are adjacent to each other.

Figure 12:
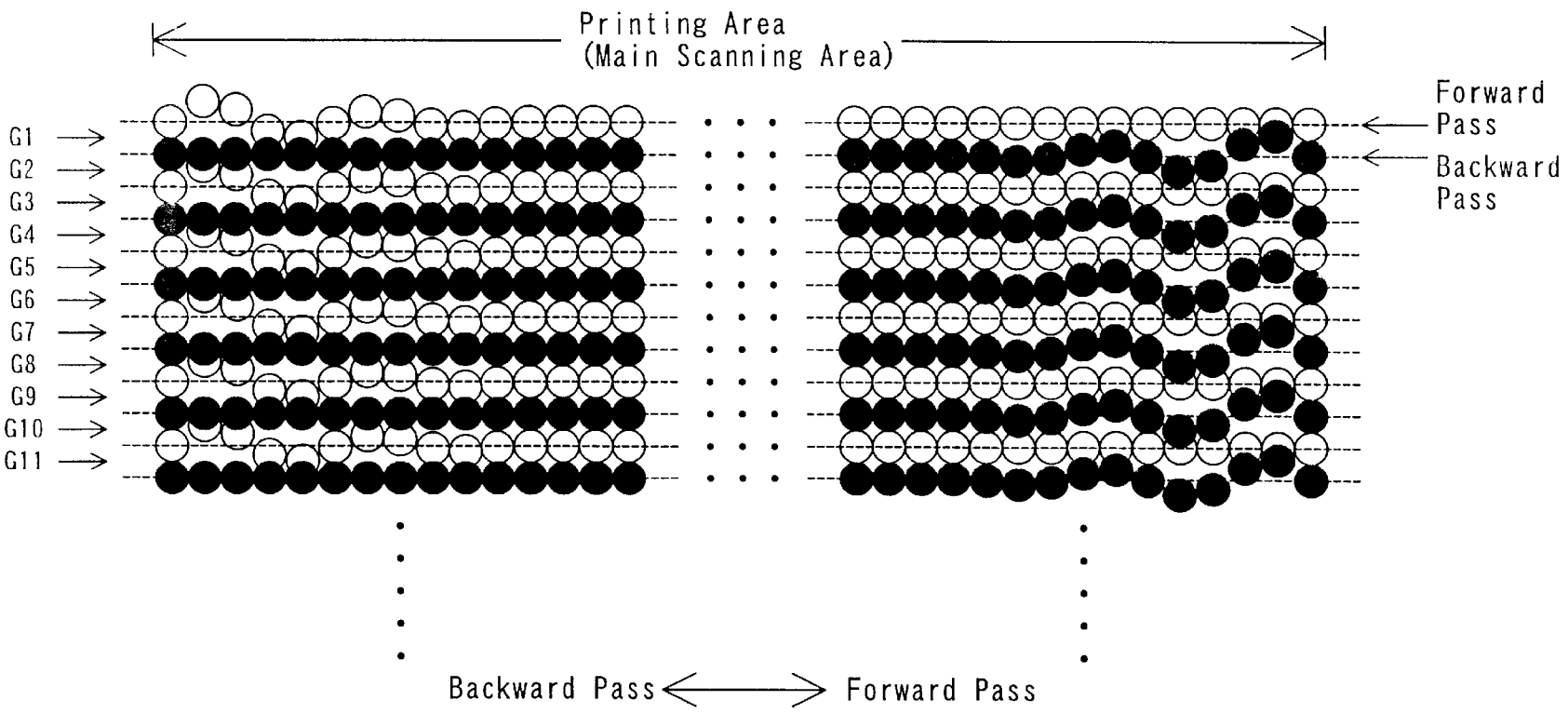
FIG. 12 shows dots created by the recording method of the second embodiment.

FIG. 12 shows resulting dots created by the recording method of the second embodiment. The open circles represent the forward pass dots, and the closed circles represent the backward pass dots. Due to the mechanical vibrations of the print head, the forward pass dots have positional misalignment in an area close to the left end, whereas the backward pass dots have positional misalignment in an area close to the right end. Although the effects of the positional misalignment of dots appear between each adjoining raster lines (G1 through G11), such misalignment is relatively inconspicuous, based on the relationship between the spatial frequency and the visual sensitivity.

Figure 13:
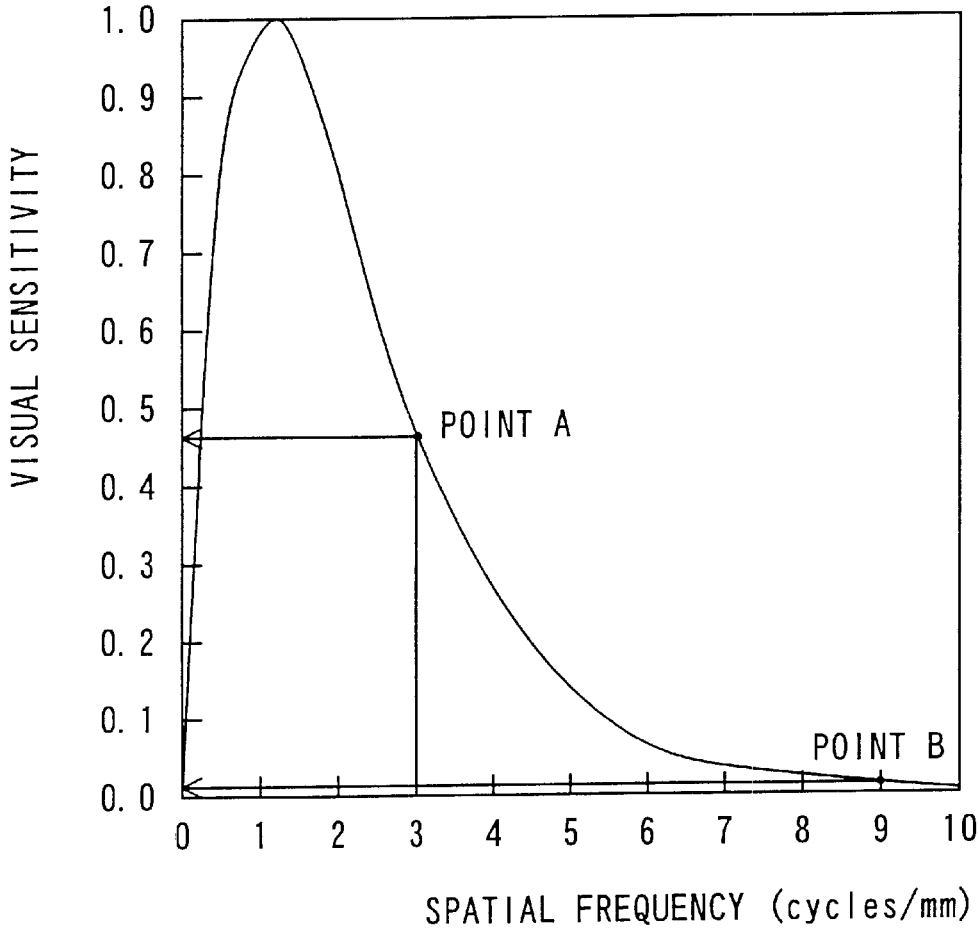
FIG. 13 is a graph showing a variation in visual sensitivity plotted against the spatial frequency.

FIG. 13 is a graph showing a variation in visual sensitivity plotted against the spatial frequency. In the range of the spatial frequency of not less than 1 cycle/mm, the visual sensitivity decreases with an increase in spatial frequency. At the resolutions typically adopted in the printing apparatus, the positional misalignment shown in FIG. 9 corresponds to a relatively low spatial frequency (point A in FIG. 13) and is rather conspicuous. The positional misalignment shown in FIG. 12, on the other hand, corresponds to a relatively high spatial frequency (point B in FIG. 13) and is relatively inconspicuous.

As described above, the technique of the second embodiment desirably reduces the adverse effects of the positional misalignment due to the mechanical vibrations and improves the picture quality of the resulting printed image. The recording method of the second embodiment may also be modified in various ways, for example, the recording method that completes each raster line by four passes of the main scan.

F. Modifications

The above embodiments are to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein. Some examples of possible modification are given below.

F1. Modification 1

Figure 14:
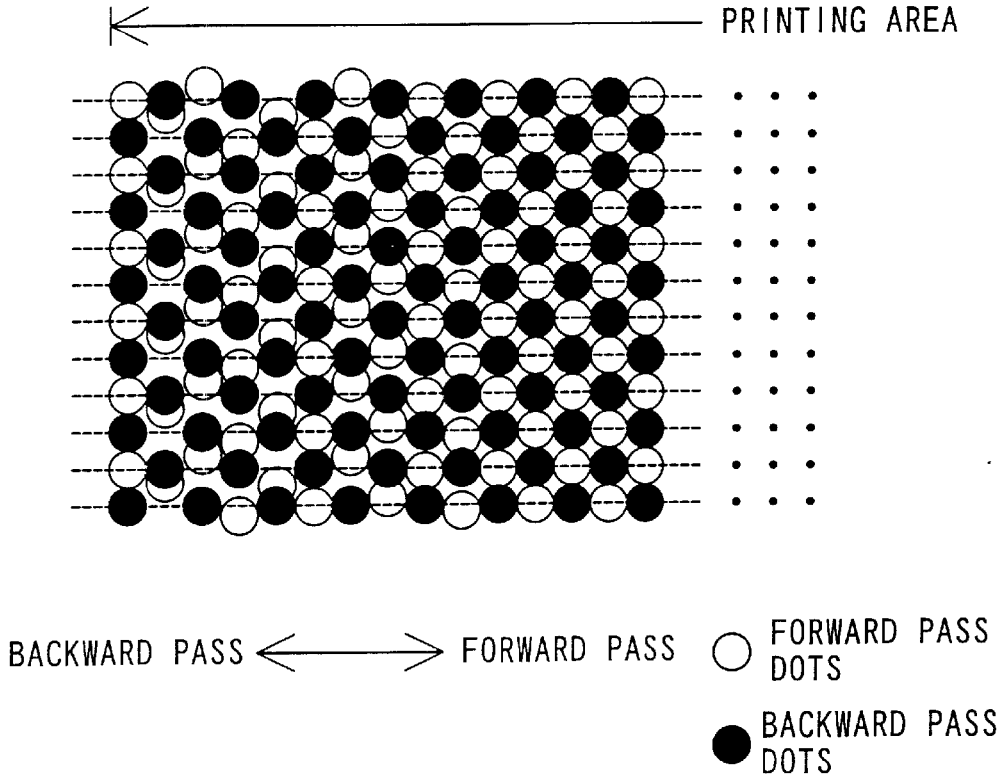
FIG. 14 shows dots created by a recording method of one modified example.
Figure 15:
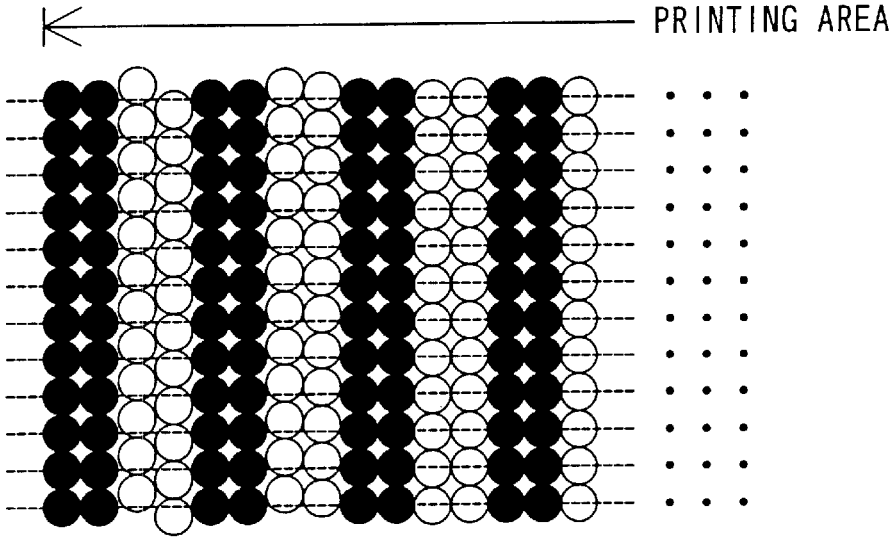
FIG. 15 shows dots created by a recording method of another modified example.

The forward pass dots and the backward pass dots may be arranged in a checker pattern as shown in FIG. 14.

F2. Modification 2

The recording method of the first embodiment may be modified adequately, as long as the forward pass dots and the backward pass dots are present on each raster line at substantially identical rates. For example, the two forward pass dots and the two backward pass dots may be created alternately.

F3. Modification 3

The recording method is required to record dots such that the forward pass dots and the backward pass dots are present at substantially identical rates in at least a specific area of low positional accuracy where the vibrations cause significant effects. In the residual area where the vibrations cause no significant effects, it is not necessary to mix the forward pass dots with the backward pass dots. Namely different recording methods may be adopted in the specific area of low positional accuracy and the residual area.

F4. Modification 4

The above embodiment regards the print head where mechanical vibrations arise in the respective initial stages of the forward pass and the backward pass of the main scan and gradually attenuate. The technique of the invention is, however, not restricted to such a print head but may generally be applicable to any print head that causes a partial area of recording to have a lower positional accuracy in the course of the main scan. For example, the technique of the present invention is applicable to a print head having mechanical vibrations that continue over the whole range of the main scan, as well as to a print head having relatively small mechanical vibrations that do not significantly affect the printing quality.

F5. Modification 5

In the above embodiment, the nozzle pitch k is set equal to the 6 dot pitch. This setting is not restrictive in any sense. For the enhanced printing quality, it is desirable to apply the irregular setting of not less than the 3 dot pitch for the feeding amount of sub-scan. This arrangement effectively disperses the positional misalignment of dots, for example, due to a variation in ink ejection properties of the print head, and thereby improves the printing quality.

F6. Modification 6

In the above embodiment, the recording method of the present invention is applied for bi-directional printing with pigment inks. The recording method of the invention is also favorably applicable to a print head that creates dots on a printing medium in such a manner that the dot percent is not greater than a predetermined level corresponding to the printing resolution. Due to the influence of the type of the printing medium, the type of inks, and the printing environment, the dot diameter may be made to be not greater than the predetermined level corresponding to the printing resolution. Even a slight positional misalignment of dot creation is likely to cause dropouts between such small-diametral dots adjoining to each other. This leads to deterioration of the printing quality. Such small-diametral dots are also affected significantly by the mechanical vibrations of the print head arising in the course of the main scan. Application of the recording method of the present invention for such dots of a relatively small diameter is thus especially effective for the improvement in printing quality.

F7. Modification 7

The above embodiment changes the recording method, based on the selection of the print mode between the pigment ink print mode and the dye ink print mode. This setting is, however, not restrictive in any sense. For example, the recording method of the present invention is applicable to print natural images. In general, the natural image includes a large number of image parts in a medium tone range, where the positional misalignment of dots is rather conspicuous compared with image parts in a low tone range or those in a high tone range. Application of the recording method of the present invention for the natural images including lots of medium tones effectively improves the printing quality in the case of bi-directional printing.

F8. Modification 8

In the above embodiment, the recording method of the present invention is adopted only in the pigment ink print mode. The recording method of the present invention may, however, be adopted in any print mode.

F9. Modification 9

The above embodiment regards the ink jet printer using piezoelectric elements. The recording method of the present invention is, however, also applicable to other printer that eject ink droplets according to other techniques; for example, a printer that supplies electricity to heaters disposed in ink conduits and ejects ink droplets by means of bubbles produced in the ink conduits.

The scope and spirit of the present invention are indicated by the appended claims, rather than by the foregoing description.

What is claimed is:

1. A print control apparatus that generates print data, which is to be supplied to a printer unit that actually creates dots on a printing medium to implement printing, said printer unit including:

a print head that causes specific partial areas of a main scan to have a lower positional accuracy of dot creation; and a head driving unit that drives said print head in both forward and backward passes of the main scan, thereby creating forward pass dots in the forward passes and backward pass dots in the backward passes; and said print control apparatus comprising:

a print data generating unit configured to generate the print data having control data that controls actuation of said print head such that a number of the forward pass dots and a number of the backward pass dots are substantially equal in at least the specific partial areas.

2. A print control apparatus in accordance with claim 1, wherein said print head has mechanical vibrations during the main scan, which cause the lower positional accuracy.

3. A print control apparatus in accordance with claim 1, wherein the specific areas are close to both ends of the main scan, and the print data causes the forward pass dots and the backward pass dots to be arranged mutually adjacent to each other on an identical raster line in at least the specific areas.

4. A print control apparatus in accordance with claim 1, wherein the specific areas are close to both ends of the main scan, and the print data causes the forward pass dots and the backward pass dots to be arranged alternately in a sub-scanning direction in at least the specific areas.

5. A print control apparatus in accordance with claim 1, wherein said print head has nozzles pitch of not less than 3 raster lines in a sub-scanning direction, said printer unit further comprises a sub-scan unit that carries out sub-scan of said print head by a predetermined feeding amount, and the print data comprises control data that controls actuation of said print head and regulates the feeding amount of sub-scan.

6. A print control apparatus in accordance with claim 1, said print control apparatus comprising:

a print mode setting unit configured to set a print mode; and a print mode control unit configured to control the print data generating unit to generate the print data in accordance with the predetermined print mode set by the print mode setting unit.

7. A print control apparatus in accordance with claim 6, wherein the predetermined print mode is used to print a natural image.

8. A printing system comprising a printer unit and a print control apparatus, said printer unit including a print head, which causes specific partial areas close to both ends of a main scan to have a lower positional accuracy of dot creation, and carrying out bi-directional printing, which causes said print head to create dots on a printing medium in both forward and backward passes of the main scan, said print control apparatus generating print data that is to be supplied to said printer unit, the print data having control data that controls actuation of said print head such that a number of forward pass dots created in the forward pass of the main scan and a number of backward pass dots created in the backward pass of the main scan are substantially equal in at least the specific partial areas of the lower positional accuracy.

9. A printing system in accordance with claim 8, wherein said print head creates the dots on said printing medium such that a dot percentage is not greater than a predetermined level corresponding to a printing resolution.

10. A printing system in accordance with claim 9, wherein said print head creates the dots with a pigment ink.

11. A method of creating dots on a printing medium to print an image, said method comprising the steps of:

(a) providing a printer unit that includes: a print head that causes specific partial areas close to both ends of a main scan to have a lower positional accuracy of dot creation; and a head driving unit that drives said print head in both forward and backward passes of the main scan; and (b) controlling actuation of said print head such that a number of forward pass dots created in the forward pass of the main scan and a number of backward pass dots created in the backward pass of the main scan are substantially equal in at least the specific partial areas of the lower positional accuracy.

12. A recording medium in which a computer program is recorded in a computer readable manner, said computer program functioning to control a printer unit that comprises a print head, which causes specific partial areas close to both ends of a main scan to have a lower positional accuracy of dot creation, and carries out bi-directional printing, which causes said print head to create dots on a printing medium in both forward and backward passes of the main scan, said computer program causing a computer to attain the function of:

generating control data that controls actuation of said print head such that a number of forward pass dots created in the forward pass of the main scan and a number of backward pass dots created in the backward pass of the main scan are substantially equal in at least the specific partial areas of the lower positional accuracy.

* * * * *